US009194181B2

(12) United States Patent
Connell et al.

(10) Patent No.: US 9,194,181 B2
(45) Date of Patent: Nov. 24, 2015

(54) MOTOR AND ROTOR CATCH ASSEMBLY

(75) Inventors: Michael L. Connell, Mustang, OK (US); Andrew M. Ferguson, Oklahoma City, OK (US); Roger L. Schultz, Ninnekah, OK (US); Brett A. Fears, Mustang, OK (US); Robert J. Farkas, Blanchard, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 463 days.

(21) Appl. No.: 13/599,901

(22) Filed: Aug. 30, 2012

(65) Prior Publication Data

US 2014/0060936 A1 Mar. 6, 2014

(51) Int. Cl.

| | |
|---|---|
| ***E21B 4/02*** | (2006.01) |
| ***E21B 21/10*** | (2006.01) |
| ***E21B 41/00*** | (2006.01) |

(52) U.S. Cl.

CPC ..... *E21B 4/02* (2013.01); *E21B 21/103* (2013.01); *E21B 41/0021* (2013.01)

(58) Field of Classification Search

CPC ..... E21B 4/00; E21B 4/02; E21B 21/10; E21B 21/103; E21B 21/12; F03B 13/02; F04D 15/0245; F04D 15/0272

See application file for complete search history.

(56) References Cited

U.S. PATENT DOCUMENTS

| | | | | |
|---|---|---|---|---|
| 3,552,412 | A * | 1/1971 | Hagar et al. | 137/70 |
| 3,989,114 | A | 11/1976 | Tschirky et al. | |
| 4,019,592 | A * | 4/1977 | Fox | 175/234 |
| 4,258,801 | A * | 3/1981 | Poston | 175/65 |
| 4,574,894 | A * | 3/1986 | Jadwin | 175/317 |
| 6,439,866 | B1 | 8/2002 | Farkas et al. | |
| 6,564,868 | B1 | 5/2003 | Ferguson et al. | |
| 8,066,059 | B2 | 11/2011 | Ferguson et al. | |
| 8,210,250 | B2 | 7/2012 | Ferguson et al. | |
| 8,230,912 | B1 | 7/2012 | Connell | |

(Continued)

FOREIGN PATENT DOCUMENTS

| | | | |
|---|---|---|---|
| CA | 2724161 | A1 | 6/2012 |
| WO | 2005-100731 | A1 | 10/2005 |

(Continued)

OTHER PUBLICATIONS

WIPO, International Search Report and Written Opinion issued in PCT/US2012/056663 on Jul. 8, 2014, which application corresponds to the above-referenced applcation.

(Continued)

*Primary Examiner* — David Bagnell
*Assistant Examiner* — Tara Schimpf
(74) *Attorney, Agent, or Firm* — Mary M. Lee

(57) ABSTRACT

A motor and rotor catch assembly for preventing loss of broken motor parts downhole. The assembly comprises a motor including a rotor supported inside a stator housing. A rotor bolt is connected to the upper end of the rotor, and is supported for axial movement within a rotor bolt housing from a running position to a deployed position. If the stator housing breaks or backs off, the attached rotor bolt shifts to the deployed position. In the deployed position, the bolt substantially reduces flow to the stator housing and simultaneously opens bypass ports to vent fluid to the annulus instead. In this way, the rotor is prevented from spinning rapidly, the diverted fluid creates a pressure change that alerts the operator to the motor failure, and the diverted fluid allows continued removal of debris and cuttings from the well bore.

9 Claims, 5 Drawing Sheets

(56) References Cited

U.S. PATENT DOCUMENTS

| | | | | |
|---|---|---|---|---|
| 8,240,373 | B1 | 8/2012 | Britton et al. | |
| 2005/0126828 | A1* | 6/2005 | Pinol et al. | 175/92 |
| 2005/0211471 | A1* | 9/2005 | Zupanick | 175/57 |
| 2006/0201675 | A1 | 9/2006 | Ferguson et al. | |
| 2008/0164062 | A1 | 7/2008 | Brackin et al. | |
| 2008/0308268 | A1* | 12/2008 | Hill et al. | 166/129 |
| 2009/0095528 | A1 | 4/2009 | Hay et al. | |
| 2010/0276204 | A1 | 11/2010 | Connell et al. | |
| 2011/0114316 | A2 | 5/2011 | Ferguson et al. | |
| 2011/0259602 | A1 | 10/2011 | Britton | |
| 2011/0315403 | A1 | 12/2011 | Nard et al. | |
| 2012/0024519 | A1 | 2/2012 | Ferguson et al. | |
| 2012/0024538 | A1 | 2/2012 | Britton | |
| 2012/0031615 | A1 | 2/2012 | Connell et al. | |
| 2012/0118557 | A1 | 5/2012 | Ferguson et al. | |
| 2012/0227970 | A1 | 9/2012 | Schultz et al. | |
| 2012/0291539 | A1 | 11/2012 | Schultz | |
| 2012/0292015 | A1 | 11/2012 | Schultz | |
| 2012/0292016 | A1 | 11/2012 | Schultz | |
| 2012/0292017 | A1 | 11/2012 | Schultz | |
| 2012/0292018 | A1 | 11/2012 | Schultz | |
| 2012/0292019 | A1 | 11/2012 | Schultz | |
| 2012/0292020 | A1 | 11/2012 | Schultz | |
| 2012/0292033 | A1 | 11/2012 | Schultz | |
| 2012/0292113 | A1 | 11/2012 | Schultz | |
| 2012/0292116 | A1 | 11/2012 | Schultz | |
| 2013/0000909 | A1 | 1/2013 | Schultz et al. | |

FOREIGN PATENT DOCUMENTS

| | | | |
|---|---|---|---|
| WO | WO2011136830 | A1 | 11/2011 |
| WO | WO2012018700 | A2 | 2/2012 |
| WO | WO2012082514 | A2 | 6/2012 |
| WO | WO2012122141 | A1 | 9/2012 |
| WO | WO2012158575 | A2 | 11/2012 |

OTHER PUBLICATIONS

WIPO, International Search Report and Written Opinion issued in PCT/US2012/056663 on Jul. 8, 2014, published Aug. 28, 2014, as WO 2014-035901 A3, which application corresponds to the above-referenced application.

* cited by examiner

MOTOR AND ROTOR CATCH ASSEMBLY

FIELD OF THE INVENTION

The present invention relates generally to downhole motors and, more particularly but without limitation, to methods and devices for preventing loss of broken motor parts downhole.

DETAILED DESCRIPTION OF THE PREFERRED EMBODIMENT(S)

Mud motors are one of the most commonly used downhole tools. Typically, the mud motor is a Moineau positive displacement type composed of an inner elongate member that rotates, namely, the rotor. The rotor is supported inside an outer tubular housing or stator equipped with a rubber liner. The upper end of the stator is connected to the drill string or coiled tubing (not shown), and the lower end of the rotor is attached to the tool or other device below that is to be driven. Rotation of the rotor is driven by fluid pumped through the drill string.

Occasionally, the stator or other parts of the motor will break as a result of excessive wear, especially in horizontal wells where the motor is subjected to more stress as it passes bends in the well bore. This breakage can result in parts of the motor being left downhole, and a fishing operation is required to recover the pieces. This is expensive and time-consuming.

The present invention provides a mud motor and rotor catch assembly that provides many advantages. A rotor bolt attached to the rotor will hold the rotor in the event of a breakage and prevent the rotor and connected tools from detaching and dropping into the well. When the rotor bolt is deployed, flow through the motor housing is substantially reduced to retard or stop rotation of the rotor. At the same time, the rotor catch assembly vents flow directly to the annulus, which will alert the operator of the rotor failure and allow continued removal of cuttings and debris from the well. These and other features of the present invention will be apparent from the following description.

Figure 1:
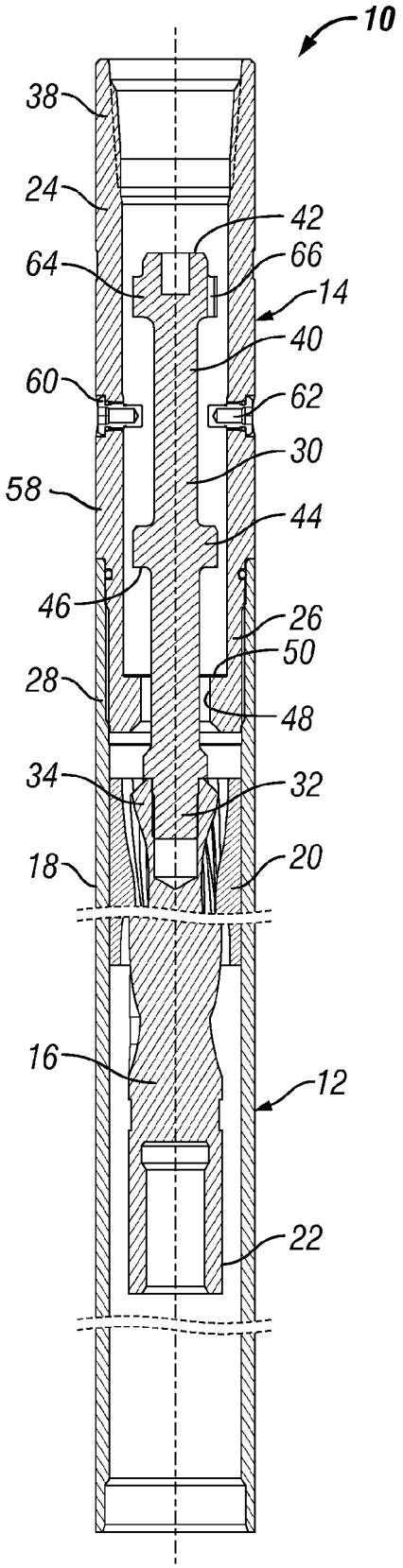
FIG. 1 is a fragmented, longitudinal sectional view of a mud motor power section and rotor catch assembly made in accordance with a first preferred embodiment of the present invention.

Turning now to the drawings in general and to FIG. 1 in particular, there is shown therein a first preferred embodiment of the mud motor and rotor catch assembly of the present invention designated generally by the reference number 10. The assembly 10 generally comprises a motor 12 and a rotor catch 14.

The motor 12 may be a conventional Moineau positive displacement type composed of an inner elongate member that rotates, namely, the rotor 16. The rotor 16 is supported inside an outer tubular stator housing 18 equipped with a rubber liner 20. Rotation of the rotor 16 is driven by fluid flow through the stator housing. The downhole end 22 of the rotor 16 is connectable to another tool or device in a known manner.

The rotor catch 14 comprises a tubular rotor bolt housing 24. The downhole end 26 of the rotor bolt housing 24 is connected to the uphole end 28 of the stator housing 18. The rotor catch 14 further comprises a rotor bolt 30. The downhole end 32 of the rotor bolt 30 is non-rotatably connected to the uphole end 34 of the rotor 16. The uphole end 38 of the rotor bolt housing 24 is connectable to the tubing string (not shown).

Figure 2:
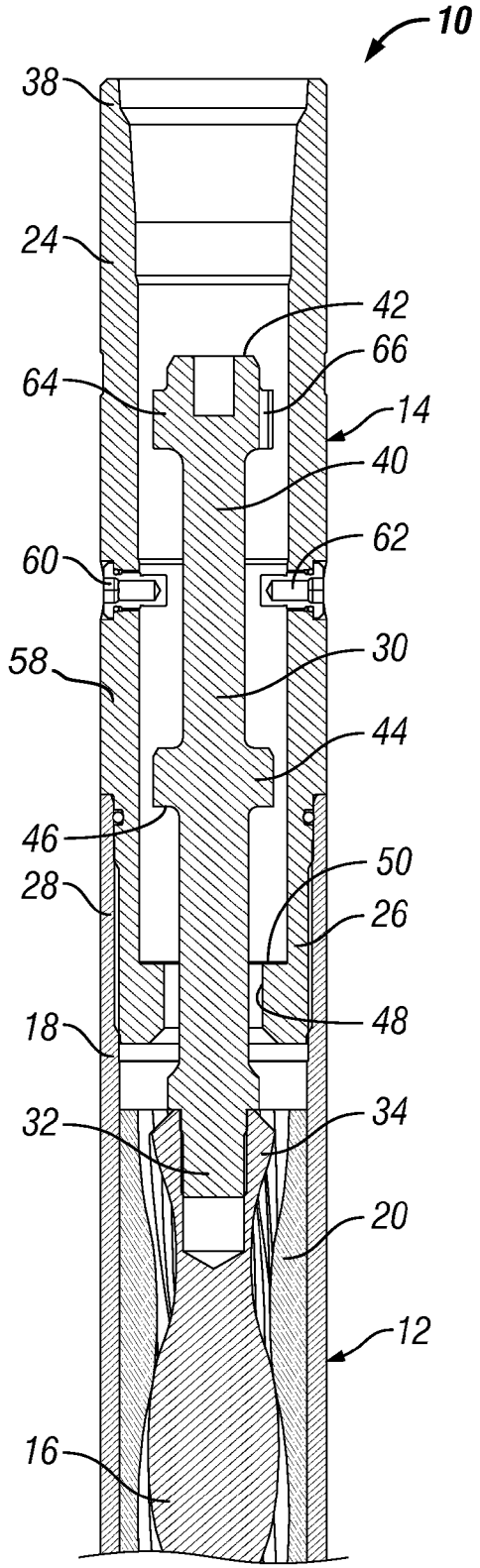
FIG. 2 is an enlarged, fragmented longitudinal sectional view of the rotor catch portion of the mud motor assembly shown in FIG. 1. The rotor catch is shown in the running or non-deployed position.
Figure 3:
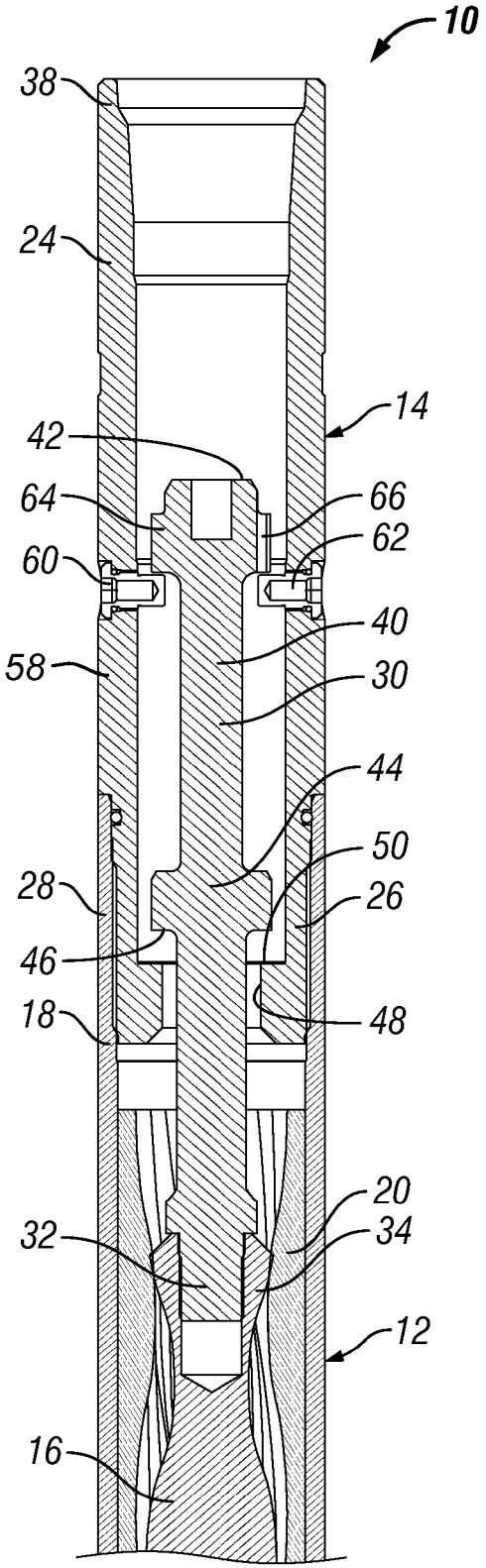
FIG. 3 is an enlarged, fragmented longitudinal sectional view of the rotor catch portion of the mud motor assembly shown in FIG. 1. The rotor catch is shown in mid stroke as the bolt head engages the ported plugs.
Figure 4:
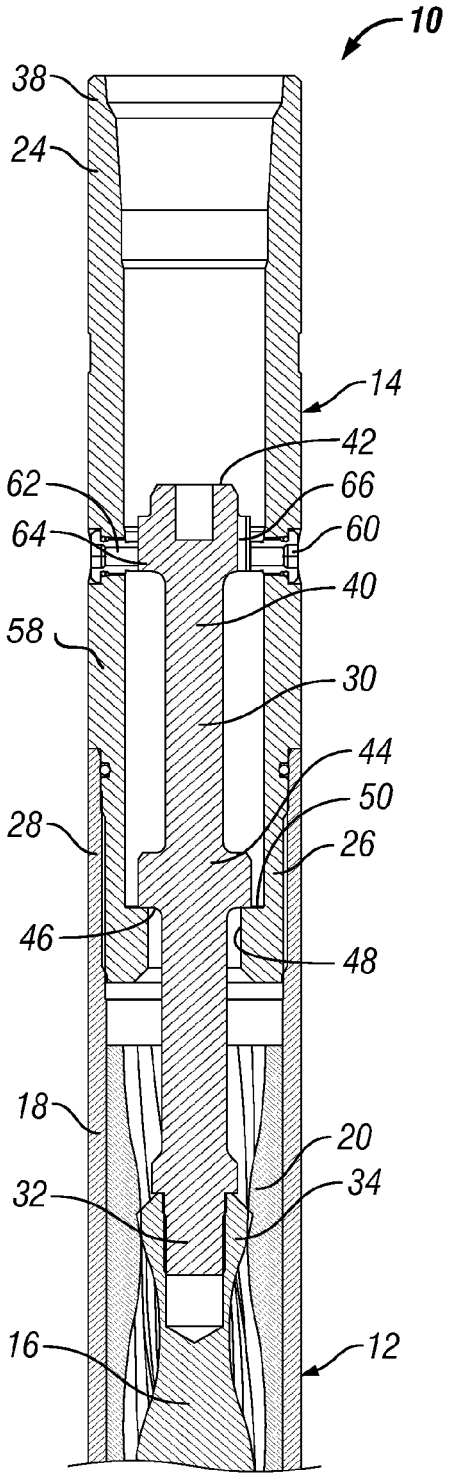
FIG. 4 is an enlarged, fragmented longitudinal sectional view of the rotor catch portion of the mud motor assembly shown in FIG. 1. The rotor catch is shown in the fully deployed position.

The rotor bolt 30 is supported for axial movement in the rotor bolt housing 24 from a neutral or running position to a deployed position, as best seen in FIGS. 2-4, to which attention now is directed. FIG. 2 illustrates the assembly 10 in the neutral or running position. In this embodiment, the rotor bolt 30 comprises an elongate body 40 extending between the uphole end 42 and the downhole end 32.

Disposed on the body 40 is an annular wider diameter portion 44 defining a downwardly facing shoulder 46. The downhole end 26 of the rotor bolt housing 24 comprises a narrowed outlet 48 through which the lower section of the rotor bolt 30 extends. The narrowed outlet 48 defines an upwardly facing shoulder 50. The upwardly facing shoulder 50 on the rotor housing 24 and the downwardly facing shoulder 46 on the rotor bolt 30 are cooperatively configured to allow an operating fluid to flow therethrough when the rotor bolt is in the running position, shown in FIG. 2.

The inner diameter of the narrowed outlet 48 is sized larger than the diameter of the rotor bolt body 40 so that the operating fluid can flow easily around the bolt body into the stator housing 18 to drive the rotor 16. In the event of a breakage, the rotor bolt 30 will be pulled downwardly to the deployed position in which the downwardly facing shoulder 46 on the rotor bolt 30 engages the upwardly facing shoulder 50 on the rotor housing 24, as shown in FIG. 4, which prevents further downward movement of the rotor bolt.

In the most preferred practice of the invention, flow to the motor 12 is substantially reduced when the rotor bolt 30 shifts to the deployed position. To that end, as seen in FIG. 4, the wider diameter portion 44 on the rotor bolt 30 is sized to obstruct flow through the outlet 48 into the stator housing 18 when the bolt 30 shifts to the deployed position.

It will be appreciated that when the rotor bolt 30 shifts to the deployed position (FIG. 4), flow through the assembly 10 would stop unless it is somehow diverted. In accordance with this preferred embodiment of the present invention, the assembly 10 provides for diversion of the operating fluid from the rotor housing 24 into the annulus around the tool, bypassing the motor 12 entirely. To that end, at least one and preferably a plurality of bypass ports 60 are provided in the sidewall 58 of the rotor bolt housing 24. These bypass ports 60, when open, fluidly connect the inside and outside of the rotor bolt housing 24.

A valve is provided for controlling the flow through the bypass ports 60 so that flow through the ports is permitted only when the rotor bolt 30 is in the deployed position. As used herein, "valve" means any mechanism for controlling flow through the bypass ports and is limited to the preferred embodiments shown and described herein.

In the present embodiment, the valve comprises ported shear plugs 62 in the bypass ports 60 and an enlarged collar 64 at or near the uphole end 42 of the rotor bolt 30. The collar 64 and shear plugs 62 are cooperatively configured so that, when the rotor bolt 30 shifts downward into the deployed position, the collar 64 shears the shear plugs opening the ports 60, as indicated in FIGS. 3 and 4. A flow path formed by openings 66 is provided in the collar 64 so that the operating fluid can then pass through the collar and out the ports 60, as seen in FIG. 4.

Figure 5:
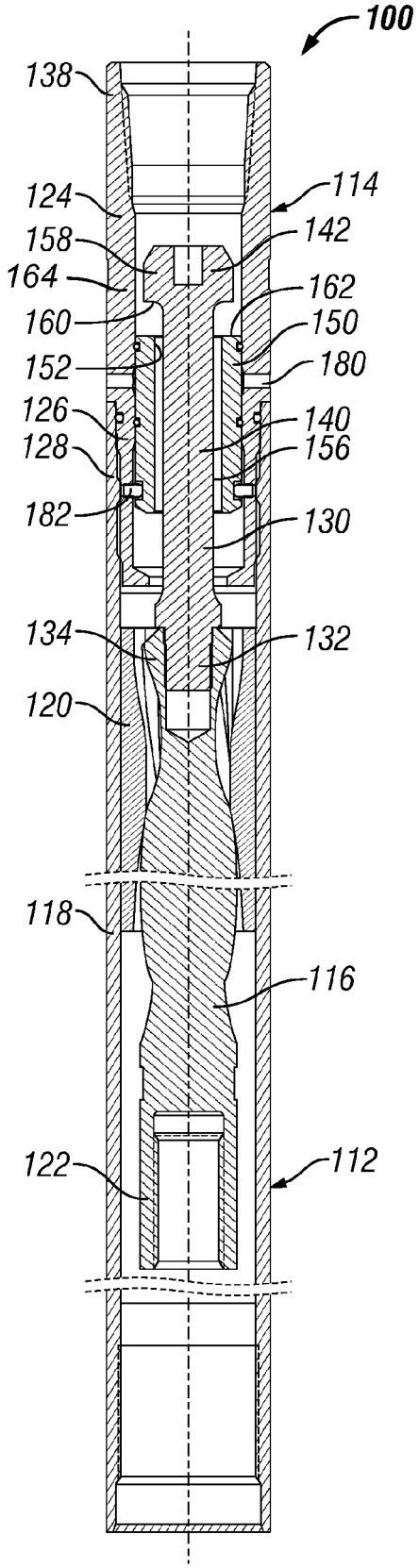
FIG. 5 is a fragmented, longitudinal sectional view of a mud motor power section and rotor catch assembly made in accordance with a second preferred embodiment of the present invention.

Turning now to FIG. 5, a second preferred embodiment of the present invention will be described. The motor and rotor catch assembly 100 of this embodiment generally comprises a motor 112 and a rotor catch 114. The motor 112 may be similar to the motor 12 in the embodiment of FIGS. 1-4 and preferably comprises a rotor 116 supported inside a stator housing 118 equipped with a rubber liner 120. The downhole end 122 of the rotor 116 is connectable to another tool or device in a known manner.

The rotor catch 114 comprises a tubular rotor bolt housing 124. The downhole end 126 of the rotor bolt housing 124 is connected to the uphole end 128 of the stator housing 118. The rotor catch 114 further comprises a rotor bolt 130. The downhole end 132 of the rotor bolt 130 is non-rotatably connected to the uphole end 134 of the rotor 116. The uphole end 138 of the rotor bolt housing 124 is connectable to the tubing string (not shown).

Figure 6:
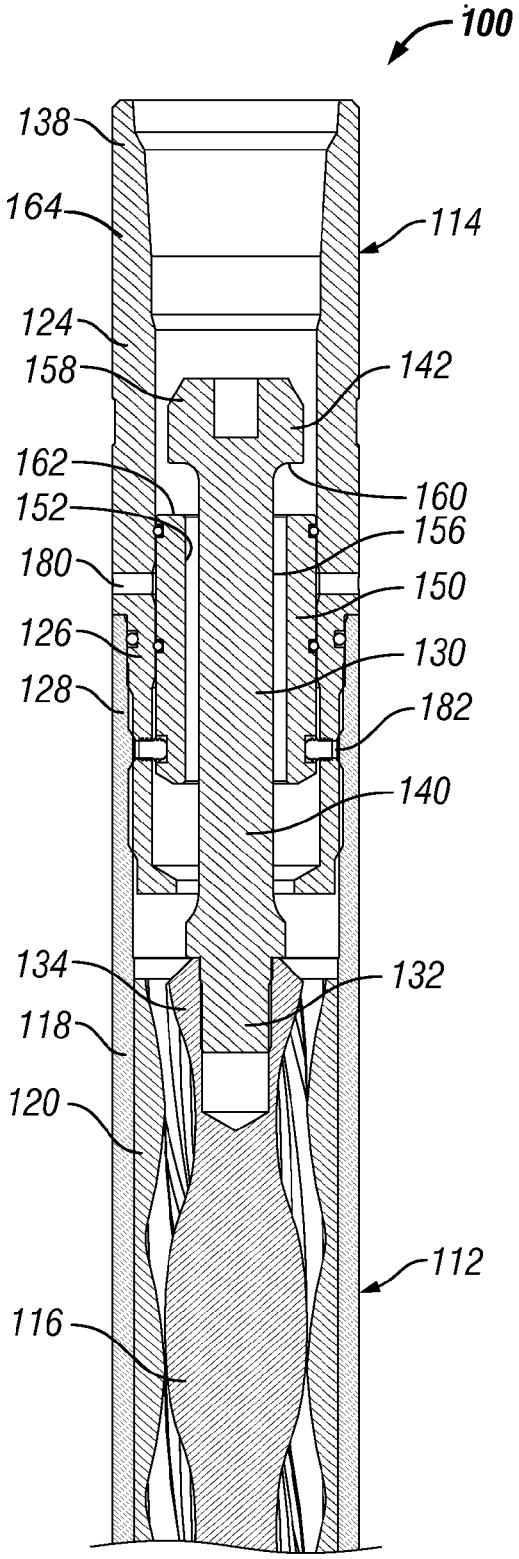
FIG. 6 is an enlarged, fragmented longitudinal sectional view of the rotor catch portion of the mud motor assembly shown in FIG. 5. The rotor catch is shown in the running or non-deployed position.
Figure 7:
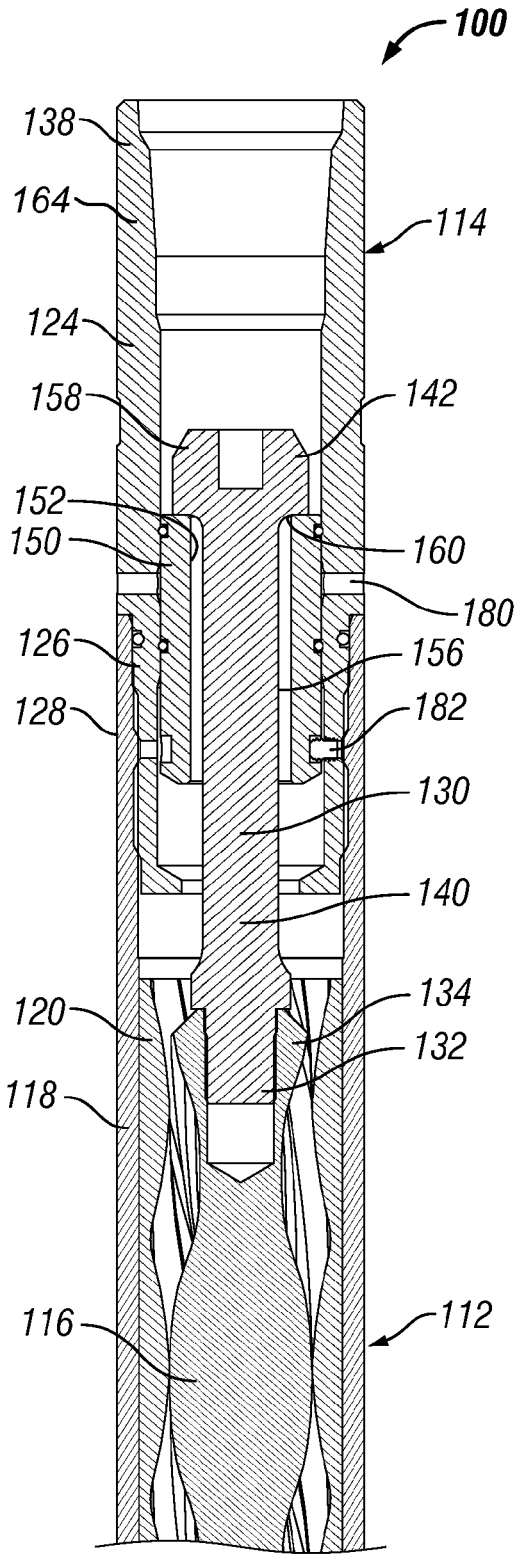
FIG. 7 is an enlarged, fragmented longitudinal sectional view of the rotor catch portion of the mud motor assembly shown in FIG. 5. The rotor catch is shown in mid stroke as the bolt head engages the piston.
Figure 8:
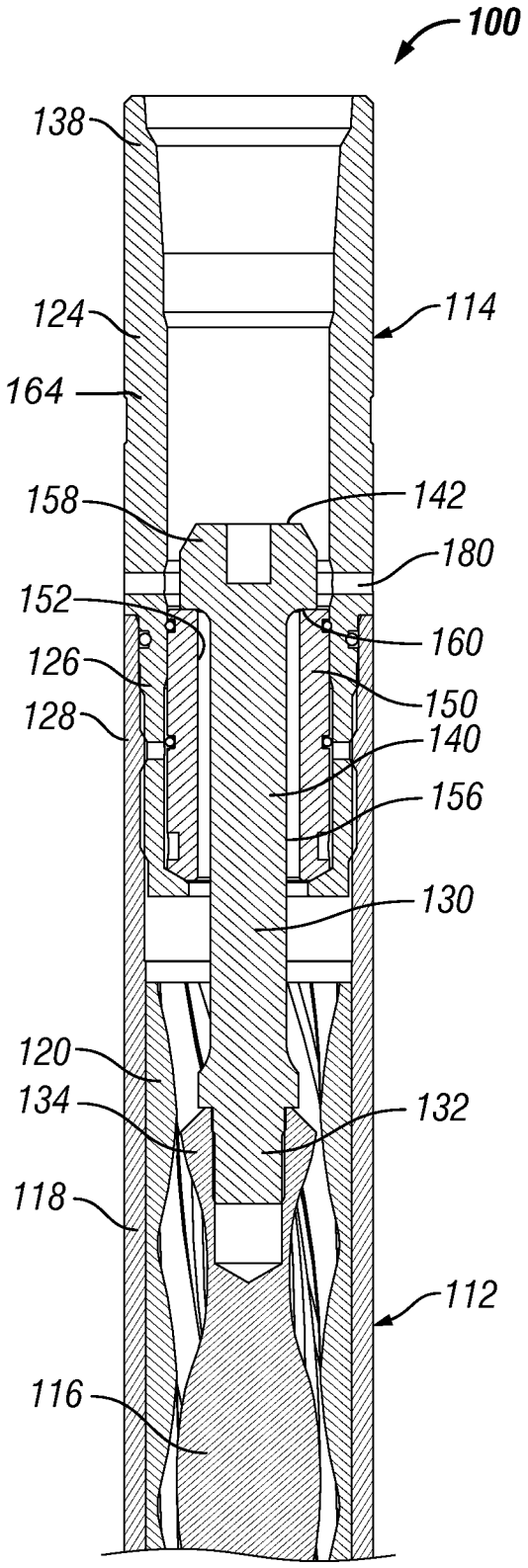
FIG. 8 is an enlarged, fragmented longitudinal sectional view of the rotor catch portion of the mud motor assembly shown in FIG. 5. The rotor catch is shown in the fully deployed position.

The rotor bolt 130 is supported for axial movement in the rotor bolt housing 124 from a neutral or running position to a deployed position, as best seen in FIGS. 6-8, to which attention now is directed. FIG. 3 illustrates the assembly 100 in the neutral or running position. In this embodiment, the rotor bolt 130 comprises an elongate body 140 extending between the uphole end 142 and the downhole end 132.

Disposed between the rotor bolt 130 and rotor bolt housing 124 is a sleeve 150 through which the rotor bolt is axially movable. The sleeve 150 has an inner diameter 152 larger than the outer diameter 156 of the rotor bolt body 140 so that in the running position operating fluid can flow easily through the sleeve into the stator housing 118 below.

At or near the uphole end 142 of the rotor bolt 130 is an annular head 158 defining a downwardly facing annular shoulder 160 configured to engage the upper end face 162 of the sleeve 150 when the rotor bolt shifts to the deployed position, as seen in FIG. 8. The downwardly facing annular shoulder 160 of the rotor bolt 130 and end face 162 of the sleeve 150 are cooperatively configured so that when the shoulder engages the end face (in the deployed position) the flow path through the sleeve is occluded. This substantially occludes fluid flow to the stator housing 118 and prevents continued rotation of the rotor 116.

This embodiment is also provided with a bypass flow into the annulus. As in the previous embodiment, the sidewall 164 of the rotor bolt housing 124 has one or more bypass ports 180. However, in this embodiment, the sleeve 150 serves as the valve for controlling flow through the ports 180. The sleeve 150 is mounted inside the rotor bolt housing 124 for axial movement between a closed position and an open position. The sleeve 150 and the bypass ports 180 are cooperatively configured so that the sleeve obstructs flow through the bypass ports when the sleeve is in the running or closed position (FIG. 6) and permits unobstructed flow through the bypass port when the sleeve is in the deployed or open position (FIG. 8).

The sleeve 150 is mounted in the closed position using one or more shear pins 182. Once the rotor bolt 130 shifts downward, closing off flow through the sleeve 150, as seen in FIG. 7, rising fluid pressure will shortly thereafter force the sleeve and rotor bolt downward breaking the shear pins 182 and dragging the sleeve to shift to the open position, as seen in FIG. 8.

Now it will be appreciated that the present invention provides a downhole motor with a rotor catch that offers many advantages. In the typical well operation employing a motor, such as drilling with a bit, fluid pressure will increase sharply as downward pressure is exerted on the drill string. When a motor fails, as in the case of a stator breakage, for example, the operator usually will notice a loss of power, that is, advancement of the drill string will no longer cause a pressure rise. However, continued fluid flow through the drill string may cause the rotor to continue to rotate. This rotation without an intact stator may cause damage to other structures in the well.

A motor equipped with the rotor catch of the present invention will alert the operator to a motor failure by exhibiting symptoms of pressure loss because the flow will be diverted to the annulus. However, because flow through the stator housing is substantially reduced, rotation of the rotor is slowed or stopped entirely, which prevents an exposed, spinning rotor from "chewing up" surrounding structures in the well. Thus, as used herein, "substantially reduced," when used to describe the effect of the flow diversion structures of this invention, does not require a complete blockage of flow but rather a reduction in flow that is sufficient to prevent the rotor from achieving enough torque to damage surrounding structures.

As used herein, phrases such as forwards, backwards, above, below, higher, lower, uphole and downhole are relative to the direction of advancement of the tool string in the well and are not limited to precisely vertical or horizontal directions.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A motor and rotor catch assembly comprising:

a motor comprising a stator housing and a rotor supported for rotation inside the stator housing in response to fluid flow through the stator housing, wherein each of the stator housing and rotor has an uphole end;

a tubular rotor bolt housing having an uphole end, a downhole end, and body extending therebetween, the body defining a sidewall, and the downhole end being attachable to the uphole end of the stator housing;

a rotor bolt having a downhole end connected to the uphole end of the rotor;

wherein the rotor bolt is supported for axial movement in the rotor bolt housing from a running position to a deployed position, wherein the rotor bolt and rotor bolt housing are configured so that in the running position fluid can flow through the rotor bolt housing and the stator housing, and so that in the deployed position fluid flow through the rotor bolt housing is diverted outside the assembly through the sidewall of the rotor bolt housing and so that fluid flow into the stator housing is substantially obstructed.

2. The motor and rotor catch assembly of claim 1 wherein the rotor bolt includes a downwardly facing annular shoulder, wherein the rotor bolt housing comprises a narrow diameter portion defining an upwardly facing shoulder, wherein the downwardly facing shoulder of the rotor bolt and the upwardly facing shoulder of the narrow diameter portion of the rotor bolt housing are cooperatively configured to allow flow therethrough in the running position and to substantially obstruct flow therethrough in the deployed position.

3. The motor and rotor catch assembly of claim 2 wherein the rotor bolt housing comprises at least one bypass port in the sidewall fluidly connecting the inside and outside of the rotor bolt housing and wherein the assembly further comprises a valve for controlling flow through the bypass port so that flow therethrough is permitted only when the rotor bolt is in the deployed position.

4. The motor and rotor catch assembly of claim 3 wherein the bypass port is provided with a ported shear plug, wherein the valve for the bypass port comprises a larger diameter collar on the rotor bolt, the collar being positioned on the rotor bolt to shear the shear plug and open the bypass port when the rotor bolt is in the deployed position, and wherein the collar defines a flow path configured to allow fluid flow from inside the rotor bolt housing through the bypass port when the rotor bolt is in the deployed position.

5. The motor and rotor catch assembly of claim 1 further comprising a sleeve in the rotor bolt housing, the rotor bolt being axially disposed inside the sleeve, wherein the sleeve has an upper end and the rotor bolt defines an annular shoulder configured to engage the upper end of the sleeve, wherein the sleeve defines a flow path configured to allow fluid flow through the sleeve when the rotor bolt is in the running position, and wherein the annular shoulder on the rotor bolt is configured to substantially obstruct the flow path through the sleeve when the rotor bolt is in the deployed position thereby substantially reducing fluid flow into the stator housing.

6. The motor and rotor catch assembly of claim 5 wherein the rotor bolt housing comprises at least one bypass port in the sidewall fluidly connecting the inside and outside of the rotor bolt housing and wherein the assembly further comprises a valve for controlling flow through the bypass port so that flow therethrough is permitted only when the rotor bolt is in the deployed position.

7. The motor and rotor catch assembly of claim 6 wherein the sleeve is axially movable in the rotor bolt housing in response to movement of the rotor bolt into the deployed position, wherein the sleeve and the bypass port are cooperatively configured so that the sleeve blocks flow through the bypass port when the sleeve is in the running position and permits flow through the bypass port when the sleeve is in the deployed position, whereby the sleeve serves as the valve for the bypass port.

8. The motor and rotor catch assembly of claim 1 wherein the rotor bolt housing comprises at least one bypass port in the sidewall fluidly connecting the inside and outside of the rotor bolt housing and wherein the assembly further comprises a valve for controlling flow through the bypass port so that flow therethrough is permitted only when the rotor bolt is in the deployed position.

9. The motor and rotor catch assembly of claim 1 wherein the rotor bolt and the rotor are both solid.

* * * * *